US007647775B2

(12) United States Patent
Muldoon et al.

(10) Patent No.: US 7,647,775 B2
(45) Date of Patent: Jan. 19, 2010

(54) AUGMENTOR SPRAY BARS

(75) Inventors: Marc J. Muldoon, Marlborough, CT (US); Tor W. Sherwood, San Diego, CA (US); Meggan H. Harris, Colchester, CT (US); Robert T. Brooks, Killingworth, CT (US)

(73) Assignee: United Technologies Corporation, Hartford, CT (US)

( * ) Notice: Subject to any disclaimer, the term of this patent is extended or adjusted under 35 U.S.C. 154(b) by 628 days.

(21) Appl. No.: 11/174,278

(22) Filed: Jun. 30, 2005

(65) Prior Publication Data

US 2007/0006590 A1 Jan. 11, 2007

(51) Int. Cl.
*F02K 3/10* (2006.01)

(52) U.S. Cl. ..... 60/761; 60/765; 60/763

(58) Field of Classification Search ..... 60/761, 60/763, 765, 762, 764, 766
See application file for complete search history.

(56) References Cited

U.S. PATENT DOCUMENTS

| | | | | |
|---|---|---|---|---|
| 2,392,682 | A * | 1/1946 | Marek | 427/237 |
| 3,800,530 | A * | 4/1974 | Nash | 60/761 |
| 3,931,707 | A * | 1/1976 | Vdoviak | 60/765 |
| 5,001,897 | A * | 3/1991 | Schultz | 60/761 |
| 5,385,015 | A | 1/1995 | Clements et al. | |
| 5,685,140 | A | 11/1997 | Clements et al. | |
| 6,038,852 | A * | 3/2000 | Celi | 60/761 |
| 2005/0084190 | A1 | 4/2005 | Brooks et al. | |

FOREIGN PATENT DOCUMENTS

| | | |
|---|---|---|
| EP | 0 750 164 A1 | 12/1996 |
| EP | 1 528 226 A2 | 5/2005 |
| GB | 1 444 679 A | 8/1976 |

OTHER PUBLICATIONS

European Search Report for EP062522859, dated Aug. 11, 2009.

* cited by examiner

*Primary Examiner*—Michael Cuff
*Assistant Examiner*—Gerald L Sung
(74) *Attorney, Agent, or Firm*—Bachman & LaPointe, P.C.

(57) ABSTRACT

A gas turbine engine fueling system includes a number of spray bars having conduits extending through associated vanes. A number of fuel injector nozzles are along each conduit. Each of the nozzles are positioned to discharge an associated fuel stream from one of the sides of the associated vane. A number of wear members are each mounted relative to the associated one of the nozzles for a range of motion relative thereto. The wear members movably cooperate with the associated vane to accommodate operating deflection and/or tolerances of the spray bars and vanes.

22 Claims, 5 Drawing Sheets

AUGMENTOR SPRAY BARS

U.S. GOVERNMENT RIGHTS

The invention was made with U.S. Government support under contract N00019-02-C-3003 awarded by the U.S. Navy. The U.S. Government has certain rights in the invention.

BACKGROUND OF THE INVENTION

This invention relates to turbine engines, and more particularly to turbine engine augmentors.

Afterburners or thrust augmentors are known in the industry. A number of configurations exist. In a typical configuration, exhaust gases from the turbine pass over an augmentor centerbody. Additional fuel is introduced proximate the centerbody and is combusted to provide additional thrust. In some configurations, the augmentor centerbody is integrated with the turbine centerbody. In other configurations, the augmentor centerbody is separated from the turbine centerbody with a duct surrounding an annular space between the two. U.S. Pat. Nos. 5,685,140 and 5,385,015 show exemplary integrated augmentors.

The centerbody may contain a burner serving as a combustion source. For introducing the additional fuel, a number of spray bars may be positioned within generally radially extending vanes. A pilot may be proximate an upstream end of the tailcone. Alternatively or additionally to the burner, a number of igniters may be positioned within associated ones of the vanes to ignite the additional fuel. Trailing portions of the vanes may serve as flameholder elements for distributing the flame across the flow path around the centerbody.

Separately, electro-graphitic carbon materials have been developed for a variety of uses. US Pre-grant Publication 20050084190A1 discloses a variable vane inner diameter (ID) bushing made from electro-graphitic carbon.

SUMMARY OF THE INVENTION

Accordingly, one aspect of the invention involves a turbine engine augmentor. A centerbody is positioned within a gas flowpath from upstream to downstream and has a downstream tailcone. A number of vanes are positioned in the flowpath outboard of the centerbody. An augmentor fueling system includes a number of spray bars having conduits extending through associated vanes. A number of fuel injector nozzles are distributed along each conduit. Each of the nozzles is positioned to discharge an associated fuel stream from one of the sides of the associated vane. A number of wear members is each mounted relative to an associated one of the nozzles for a range of motion relative thereto and moveably cooperate with the associated vane to accommodate operating deflection (e.g., differential thermal expansion or loading deformation) and/or tolerance of the spray bars and vanes.

In various implementations, the augmentor may be non-remote or remote. The augmentor fueling system may comprise a manifold within the centerbody feeding the spray bars. Each of the vanes may include a main body and a trailing edge box structure assembled to the main body. The wear members may each comprise an electrographitic carbon body. The wear members may each comprise a material softer than an adjacent material of the associated nozzle and an adjacent material of the associated vane body. The nozzles may include paired nozzles along opposite sides of each of the vanes or of every augmentor vane. The wear members may be removable from the associated nozzles nondestructively of such nozzles. The wear members may be secured to the nozzles by retainers interfitting with the wear members and nozzles. Each of the wear members may be moveable between an inward extreme and an outward extreme. At the inward extreme, the associated retainer may contact a boss of the associated spray bar. At the outward extreme, the associated retainer may contact an underside of a head of the associated nozzle. The boss and nozzle may be brazed or welded to each other. The retainer may be a bent wire. The wear members may be spring biased toward the outward extreme.

Another aspect of the invention involves electrographitic carbon wear blocks. Another aspect of the invention involves removable wear blocks secured to associated nozzles by retainer clips. The clips may have first and second legs received in first and second holes in the wear blocks. The first and second holes may intersect a nozzle-receiving aperture. The various aspects of the invention may be implemented in the manufacturing or remanufacturing of an engine or in the reengineering of an engine configuration from a baseline lacking such wear members (e.g., a baseline configuration wherein the wear members are metal and integrated to remaining portions of the spray bars).

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
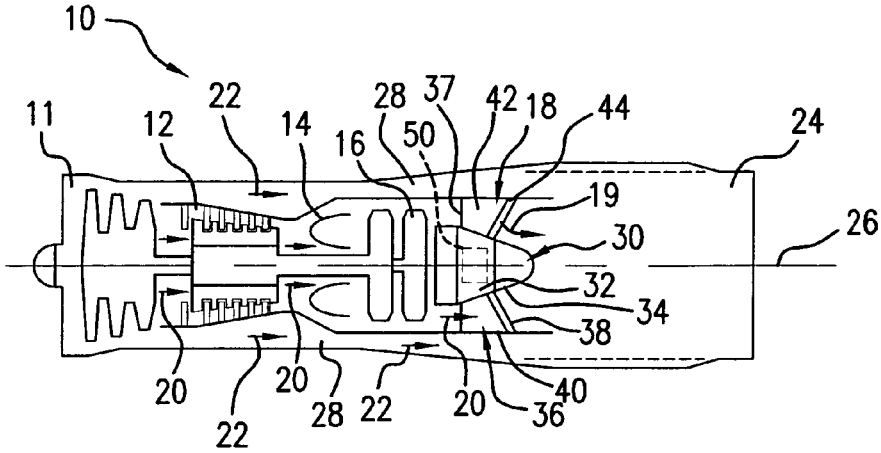
FIG. 1 is a schematic longitudinal sectional view of an aircraft powerplant.

FIG. 1 shows a gas turbine engine 10 comprising, from upstream to downstream and fore to aft, a fan 11, a compressor 12, a combustor 14, a turbine 16, and an augmentor 18. Air entering the fan 11 is divided between core gas flow 20 and bypass air flow 22. Core gas flow 20 follows a path initially passing through the compressor 12 and subsequently through the combustor 14 and turbine 16. Finally, the core gas flow 20 passes through the augmentor 18 where additional fuel 19 is selectively added, mixed with the flow 20, and burned to impart more energy to the flow 20 and consequently more thrust exiting an engine nozzle 24. Hence, core gas flow 20 may be described as following a path essentially parallel to the axis 26 of the engine 10, through the compressor 12, combustor 14, turbine 16, and augmentor 18. Bypass air 22 also follows a path parallel to the axis 26 of the engine 10, passing through an annulus 28 along the periphery of the engine 10 to merge with the flow 20 at or near the nozzle 24.

Figure 2:
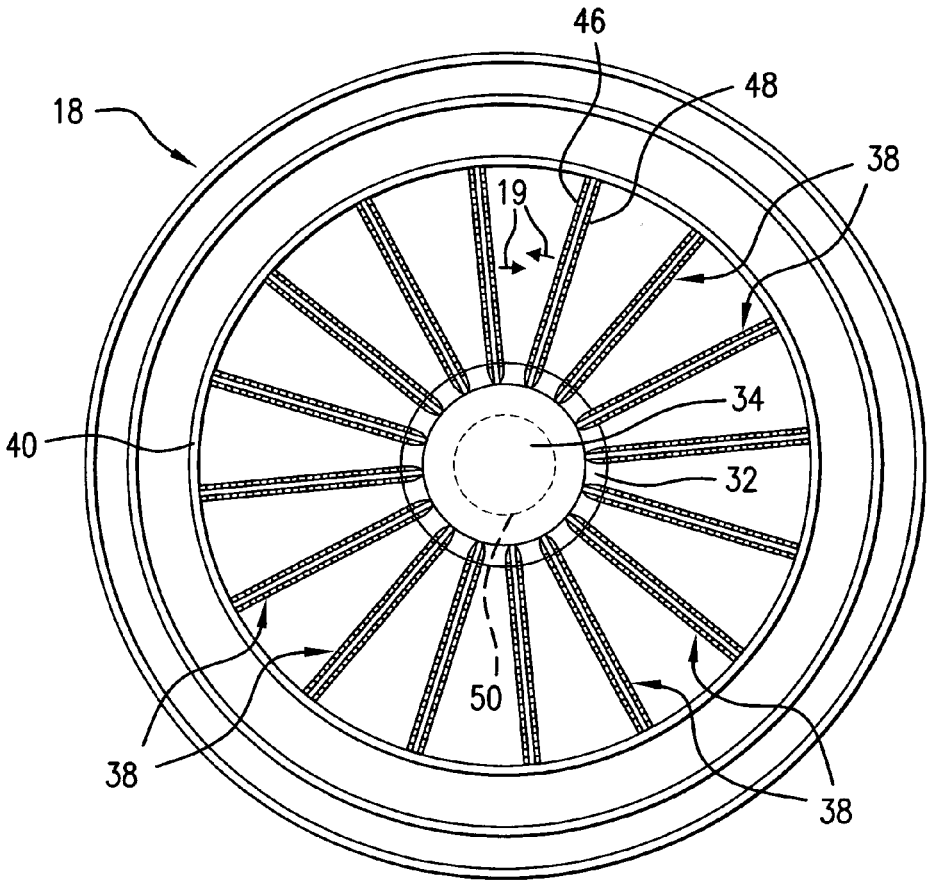
FIG. 2 is an aft view of an augmentor of the powerplant of FIG. 1.

The augmentor comprises a centerbody 30 generally symmetric around the axis 26 and formed as a portion of an engine hub. The exemplary centerbody has a main portion 32 and a tailcone 34 downstream thereof. Circumferentially arrayed vanes 36 have leading and trailing extremities 37 and 38 and extend generally radially between the centerbody 30 and a turbine exhaust case (TEC) 40. Each of the vanes may be an assembly of a leading main body portion 42 and a trailing edge box 44. The vanes have circumferentially opposite first and second sides 46 and 48 (FIG. 2). The trailing edge box 44 may contain a spray bar (discussed below) for introducing the additional fuel 19. The centerbody may contain a burner 50 for combusting fuel to, in turn, initiate combustion of the fuel 19. The burner 50 and spray bars may be supplied from one or more supply conduits (not shown) extending through or along one or more of the vanes to the centerbody. As so far described, the engine configuration may be one of a number of existing engine configurations to which the present teachings may apply. However, the teachings may also apply to different engine configurations.

Figure 3:
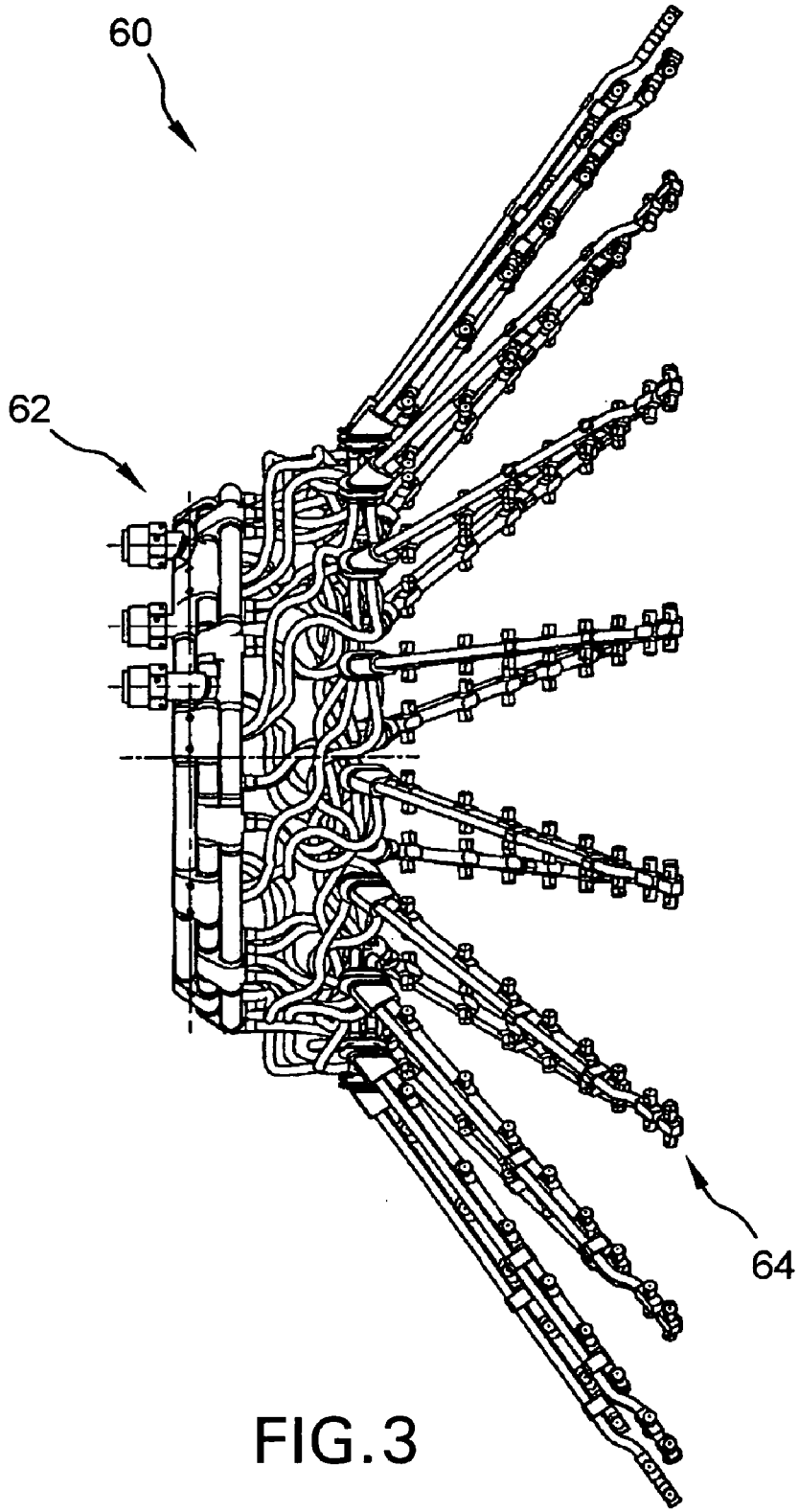
FIG. 3 is a side view of a spray bar array and fueling manifold of the augmentor of FIG. 2.
Figure 4:
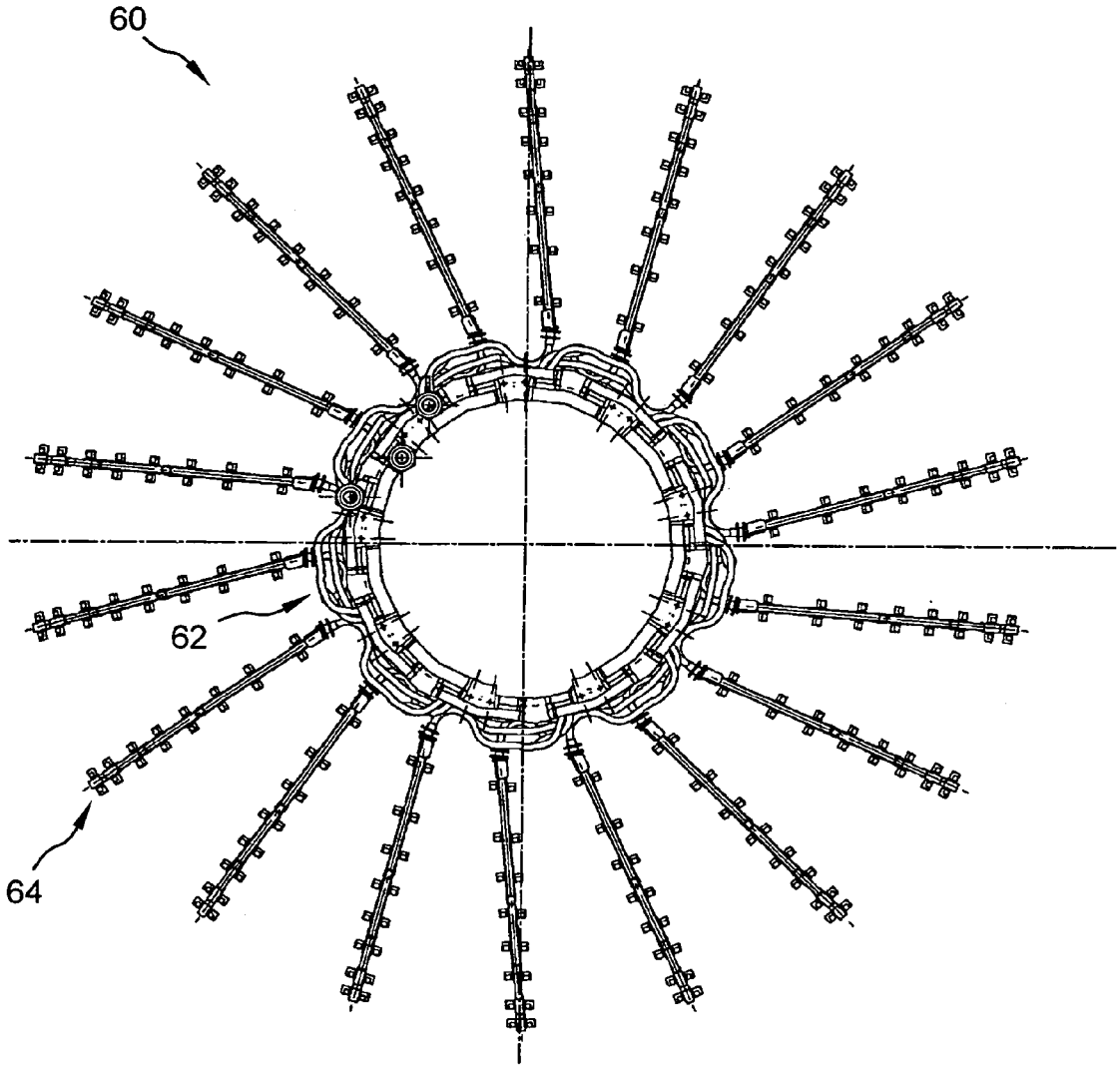
FIG. 4 is a front view of the spray bar array and manifold of FIG. 3.
Figure 5:
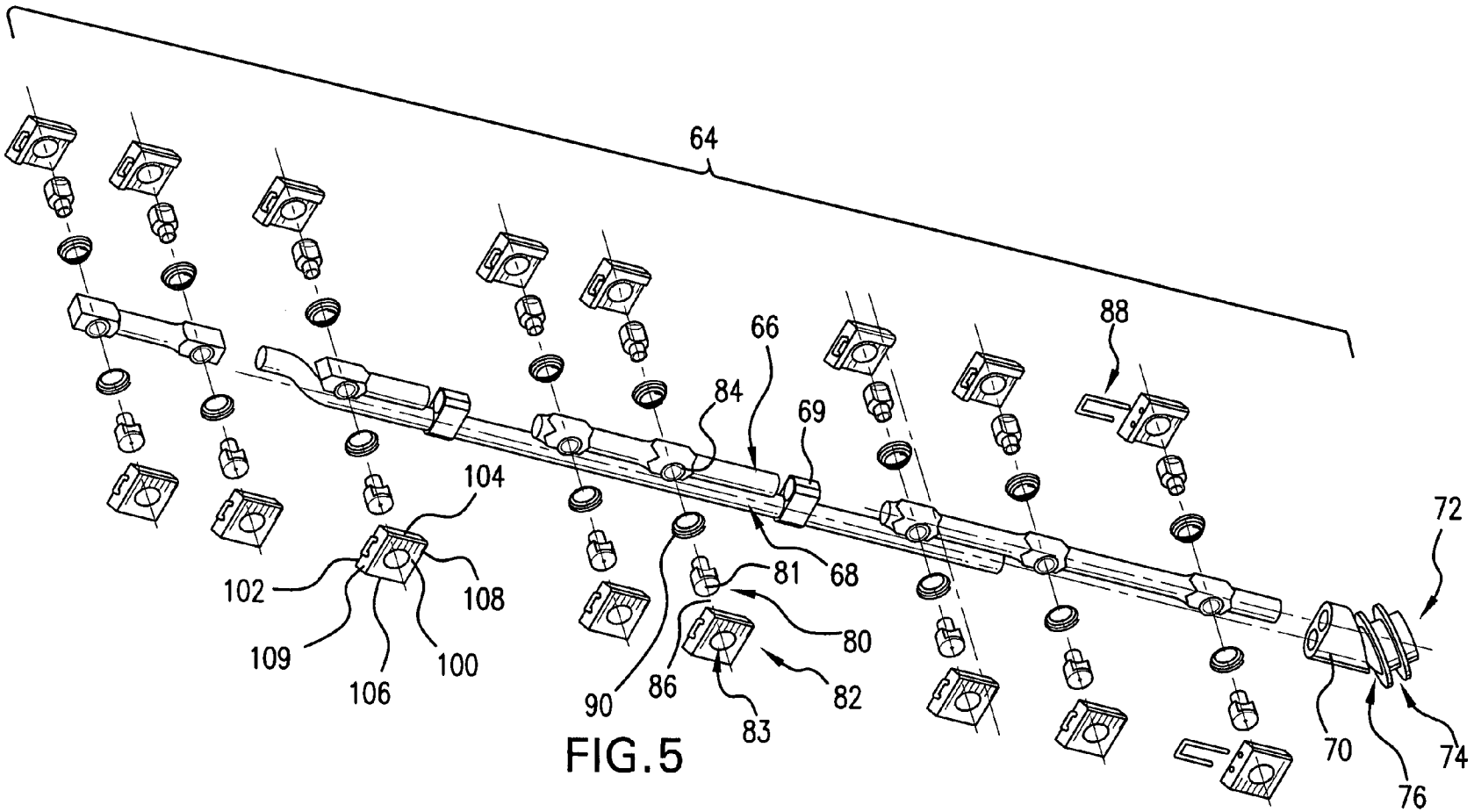
FIG. 5 is a partially exploded view of a spray bar of the array of FIGS. 3 and 4.

FIGS. 3 and 4 show portions of an augmentor fueling system 60 including a manifold 62 for feeding fuel to an array of spray bars 64. The manifold 62 may be located within the centerbody 30. FIG. 5 shows further details of an exemplary spray bar 64. The exemplary spray bar is a dual conduit spray bar having first and second conduits 66 and 68. The conduits 66 and 68 are secured to each other by blocks 69 having a pair of apertures respectively receiving the conduits. The conduits have proximal end portions mounted to outlets of a spray bar block 70 (e.g., by brazing or welding). The block 70 has an inboard end 72 bearing inlets for connection to the manifold 62. The exemplary block 70 includes inboard and outboard slots 74 and 76 extending circumferentially around the block 70. The inboard slot 74 receives a seal (not shown) for engaging the centerbody structure. The outboard slot 76 receives first and second side halves of the associated vane. Each of the spray bars carries a plurality of nozzles 80 and wear blocks 82. Each nozzle has an aperture 81 for discharging an associated jet of fuel. Each wear block has a central aperture 83 which receives the associated nozzle 80. Whereas prior art systems provide wear blocks, nozzles, and spray bars as unitary or integrated (e.g., by welding or brazing) structures, the exemplary wear blocks 82 are otherwise formed. In the exemplary embodiment, each of the nozzles 80 is integrated (e.g., by brazing or welding) with an associated boss 84 of the associated conduit 66 or 68. The wear block 82, however, is formed of a material that wears preferentially relative to adjacent material of the vane and nozzle. The wear block 82 may be mounted for reciprocal motion along a nozzle axis 86 by means of a retainer 88. A spring 90 (e.g., compressed between the block 82 and the associated conduit) may bias the block 82 outward. In addition to wearing preferentially to mating details, the electrographitic material used for the wear members may deposit a thin layer of graphite at the wear interface. This deposition may serve to further reduce the rates of wear. Additionally, the electro-graphitic carbon has advantageous temperature stability relative to polymers and other non-metallic sacrificial wear materials used in other applications.

Each exemplary block 82 has an outboard face or side 100, an inboard face or side 102, first and second lateral faces or sides 104 and 106, and first and second longitudinal faces or sides 108 and 109 (e.g., proximal and distal relative to the length of the spray bar).

Figure 6:
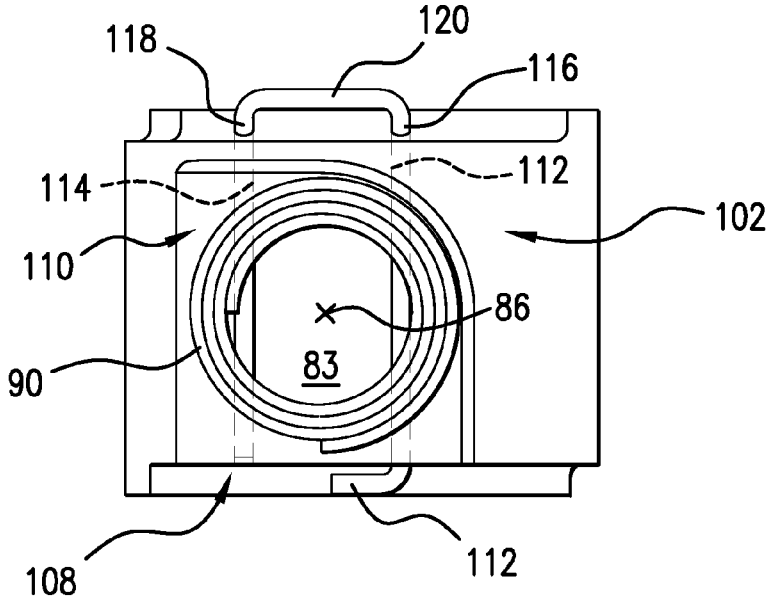
FIG. 6 is an inboard end view of a wear block of the spray bar of FIG. 5.

FIG. 6 shows the inboard side of the block, retainer, and spring assembly (with the nozzle removed for illustration). The block inboard side 102 has a recessed area 110 for receiving the spring 90 and against which the spring 90 bears in compression. On opposite sides of the axis 86 and extending perpendicular thereto, the block has a pair of straight holes or channels 112 and 114 which receive associated legs 116 and 118 of the retainer 88. A head or cross-member 120 of the retainer joins the legs 116 and 118. A distal end portion 122 of the leg 116 protrudes from an outlet of the hole 112 at the side 108 and is bent over to retain the retainer against extraction or loss of the retainer 88. In the exemplary embodiment, the channels extend entirely through the central aperture 83 (e.g., as opposed to extending into the aperture and terminating). As is discussed below, the portions of the legs 116 and 118 within the apertures 83 retain the blocks relative to the associated nozzles.

Figure 7:
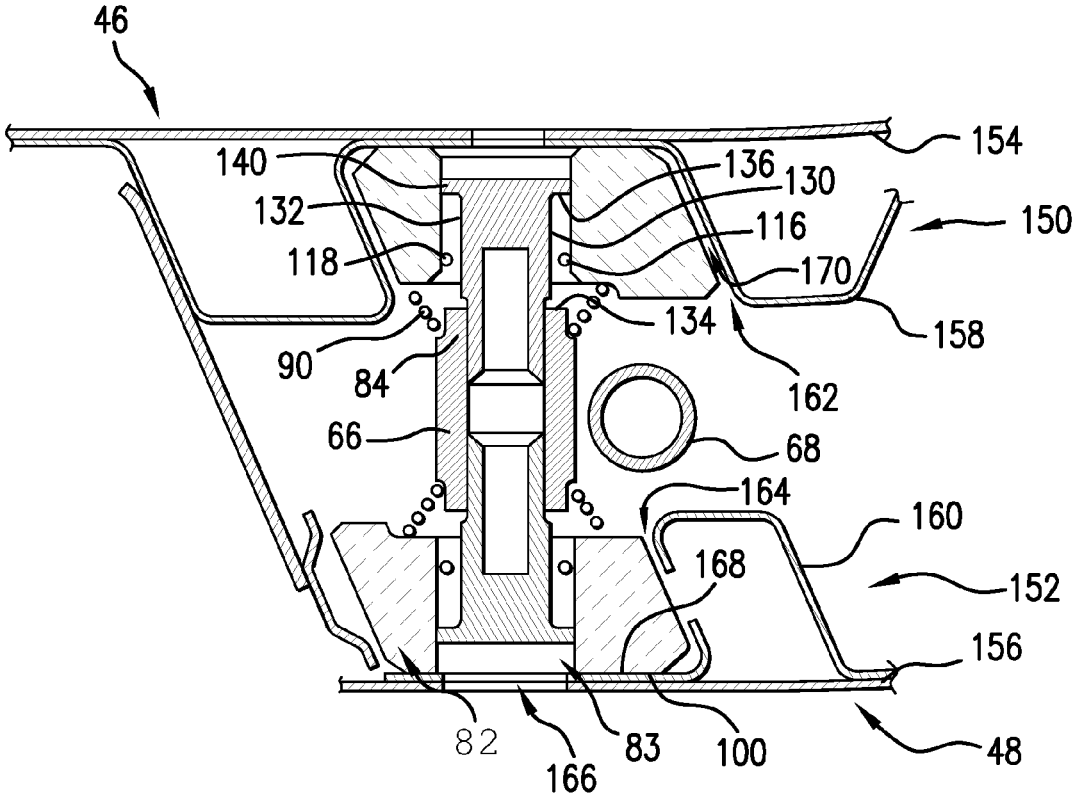
FIG. 7 is a partial sectional view of a vane of the augmentor of FIG. 2.

FIG. 7 shows the legs 116 and 118 of a retainer 88 along side flats 130 and 132 of the associated nozzle, captured between a rim 134 of the boss 84 and an underside 136 of a head 140 of the nozzle. In the exemplary embodiment, the nozzles are paired one on each side of the pair of conduits 66, 68 but not exactly coaxially aligned (i.e., the axes 86 of each pair are slightly offset from each other so that there is only partial overlap of the opposite apertures in the bosses 84). Thus, the view plane of FIG. 7 is spaced between the axes of the outlet apertures 81 of each nozzle in the pair.

FIG. 7 further shows cooperation of the blocks with the vane first and second side halves 150 and 152. Each half includes an outer skin 154; 156 and inner structural corrugations 158; 160 secured thereto (e.g., by welding or brazing). Each wear block 82 fits within a compartment 162, 164 in the associated half 150, 152. Each half may have a series of apertures 166 aligned with the block apertures 83 and nozzle apertures 81 to permit passage of the associated fuel jet 19. Each spring 90 biases the associated wear block 82 outward so that the wear block outboard face 100 is maintained in contact with an inboard face 168 of the associated vane half 150; 152. In normal operation, this position may be generally intermediate in the block range of reciprocal motion, with the range of motion accommodating wear, operating deflections (e.g., differential thermal expansion or differential deformation due to pressure or g-loading), vibration, and the like so as to maintain an effective air seal between the spraybar and vane or trailing edge box. Wearability and deformability of the blocks may also help accommodate such differential thermal expansion and accommodate stacked manufacturing tolerances. Laterally of each block, there may be slight gaps 170 between the associated lateral faces 104 and 106 and the adjacent vane material (e.g., of the structural corrugation 158; 160).

Any of a variety of assembly techniques may be used to assemble each spray bar. In the exemplary spray bar, the first conduit 66 is assembled from a longitudinal stacking of machined pieces, assembled with the blocks 69 and 72, and brazed. The second conduit 68 includes a tube assembled to a machined end piece to feed the most distal/outboard injectors (e.g., by brazing). This tube is inserted through the blocks 69 and into the block 72 and brazed thereto. The nozzles 80 may be brazed into their associated bosses 84. The springs 90 may be placed over the nozzles or preinstalled prior to nozzle installation. The blocks 82 are then installed so that their apertures 83 receive the nozzles 80. Further block movement compresses the associated spring 90. The retainers 88 are then inserted and the end portions 122 of the legs 116 bent over (e.g., manually by pliers or similar tool).

After a period of use, the wear blocks will become worn due to their engagements with the nozzles 80 and vane halves 150 and 152. Exemplary nozzles are formed of nickel-based superalloy. Exemplary vane corrugations 158 and 160 are formed of nickel-based superalloy. It has been determined that electrographitic carbon is an advantageous block material to engage and preferentially wear relative to such nozzles and structures. After wear, the spray bar may be remanufactured. Exemplary remanufacturing involves separating the two vane halves to expose the blocks. The retainers are removed (e.g., by straightening the end portion 122 or cutting them off and then extracting the remainder). The blocks may then be removed. The springs may similarly be removed if it is desired to replace the springs with new springs. New springs (if any) may then be installed followed by a new block and new retainer. The vane halves may then be reassembled over the spray bar.

One or more embodiments of the present invention have been described. Nevertheless, it will be understood that various modifications may be made without departing from the spirit and scope of the invention. The inventive spray bars may be applied in a retrofit or redesign of an otherwise existing engine. In such cases, various properties of the spray bars would be influenced by the structure of the existing engine. While illustrated with respect to an exemplary center-fueled spray bar, non-remote augmentor situation, the principles may be applied to remote augmentors and to spray bars fueled from their outboard ends. Accordingly, other embodiments are within the scope of the following claims.

What is claimed is:

1. A turbine engine augmentor comprising:

a centerbody within a gas flowpath from upstream to downstream and having a downstream tailcone; and a plurality of vanes positioned in the gas flowpath outboard of the centerbody and having first and second sides;

an augmentor fueling system comprising:

a plurality of spray bars, each spray bar at least partially within an associated at least one of said vanes, comprising:

a conduit; and a plurality of nozzles coupled to the conduit, each nozzle positioned to discharge an associated fuel stream from one of the sides of the associated vane; and a plurality of blocks, each block mounted within the associated vane relative to an associated one of the nozzles for a range of motion relative thereto between an inward extreme and an outward extreme and movably cooperating with the associated vane, wherein there are nozzles along each of the first side and second side of each of the vanes and each said vane contains a plurality of said blocks, each said block mounted to the associated said nozzle.

2. The augmentor of claim 1 wherein the augmentor is a non-remote augmentor.

3. The augmentor of claim 1 wherein the augmentor fueling system comprises:

a manifold within the centerbody feeding the plurality of spray bars.

4. The augmentor of claim 1 wherein each of said plurality of vanes comprises:

a main body; and a trailing edge box structure.

5. The augmentor of claim 1 wherein the blocks each comprise an electro-graphitic carbon body.

6. The augmentor of claim 1 wherein the blocks each comprise a material softer than an adjacent material of the associated nozzle and an adjacent material of the associated vane body.

7. The augmentor of claim 1 wherein the plurality of nozzles include paired nozzles along opposite sides of each of the vanes.

8. The augmentor of claim 1 wherein the plurality of nozzles include paired nozzles along opposite sides of every augmentor vane.

9. The augmentor of claim 1 wherein each of the plurality of blocks are removable from the associated nozzle nondestructively of said nozzle.

10. The augmentor of claim 1 wherein each of the plurality of blocks are secured to the associated nozzle by a retainer interfitting with said block and said nozzle.

11. The augmentor of claim 10 wherein each of the plurality of blocks is moveable between the inward extreme wherein the associated retainer contacts a boss of the associated spray bar and the outward extreme wherein the associated retainer contacts an underside of a head portion of the associated nozzle, the boss and nozzle being brazed or welded to each other.

12. The augmentor of claim 1 wherein each of the plurality of blocks are secured to the associated nozzle by a bent wire retainer interfitting with said block and said nozzle.

13. The augmentor of claim 1 wherein each of the plurality of blocks is biased by a spring.

14. A turbine engine augmentor comprising:

a centerbody within a gas flowpath from upstream to downstream and having a downstream tailcone; and a plurality of vanes positioned in the gas flowpath outboard of the centerbody and having first and second sides;

an augmentor fueling system comprising:

a plurality of spray bars, each spray bar at least partially within an associated at least one of said vanes, comprising:

a conduit; and a plurality of nozzles coupled to the conduit, each nozzle positioned to discharge an associated fuel stream from one of the sides of the associated vane; and means within the vanes movably intervening between both the spray bars and the vanes for accommodating operating deflection of at least one of the spray bars and vanes wherein the means are associated with the nozzles.

15. A turbine engine augmentor comprising:

a centerbody within a gas flowpath from upstream to downstream and having a downstream tailcone; and a plurality of vanes positioned in the gas flowpath outboard of the centerbody and having first and second sides;

an augmentor fueling system comprising:

a plurality of spray bars, each spray bar at least partially within an associated at least one of said vanes, comprising:

a conduit; and a plurality of nozzles coupled to the conduit, each nozzle positioned to discharge an associated fuel stream from one of the sides of the associated vane; and a plurality of blocks, each block mounted within the associated vane relative to an associated one of the nozzles and movably cooperating with the associated vane, and comprising electro-graphitic carbon.

16. The augmentor of claim 15 wherein each of the plurality of blocks are removable from the associated nozzle nondestructively of said nozzle.

17. A turbine engine augmentor comprising:

a centerbody within a gas flowpath from upstream to downstream and having a downstream tailcone; and a plurality of vanes positioned in the gas flowpath outboard of the centerbody and having first and second sides;

an augmentor fueling system comprising:

a plurality of spray bars, each spray bar at least partially within an associated at least one of said vanes, comprising:

a conduit; and a plurality of nozzles coupled to the conduit, each nozzle positioned to discharge an associated fuel stream from one of the sides of the associated vane; and a plurality of blocks, each block mounted within the associated vane relative to an associated one of the nozzles and removable from the associated nozzle nondestructively of said nozzle movably cooperating with the associated vane, and comprising a material that preferentially wears relative to an adjacent material of the associated vane, each of the plurality of blocks are secured to the associated nozzle by a retainer interfitting with said block and said nozzle.

18. The turbine engine augmentor of claim 17 wherein each said block is retained by a bent wire retainer.

19. The turbine engine augmentor of claim 17 wherein each block comprises:

an aperture for receiving the associated nozzle; and first and second holes transverse to and intersecting the aperture for respectively first and second legs of said retainer.

20. The turbine engine augmentor of claim 19 comprising an electro-graphitic carbon body.

21. The turbine engine augmentor of claim 19 wherein the first and second holes extend through the aperture.

22. The turbine engine augmentor of claim 19 having first and second lateral wear surfaces generally parallel to each other and off-parallel to a central longitudinal axis of the aperture.

* * * * *

UNITED STATES PATENT AND TRADEMARK OFFICE

CERTIFICATE OF CORRECTION

PATENT NO. : 7,647,775 B2
APPLICATION NO. : 11/174278
DATED : January 19, 2010
INVENTOR(S) : Muldoon et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1077 days.

Signed and Sealed this

Twenty-eighth Day of December, 2010

David J. Kappos

David J. Kappos
*Director of the United States Patent and Trademark Office*